US006673470B2

(12) United States Patent
Shigekuni et al.

(10) Patent No.: US 6,673,470 B2
(45) Date of Patent: Jan. 6, 2004

(54) SURFACE TREATED TIN-PLATED STEEL SHEET AND SURFACE TREATMENT SOLUTION

(75) Inventors: Tomofumi Shigekuni, Chiba (JP); Hisatada Nakakoji, Chiba (JP); Kazuo Mochizuki, Tokyo (JP); Chiaki Kato, Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 10/169,563

(22) PCT Filed: Oct. 26, 2001

(86) PCT No.: PCT/JP01/09424

§ 371 (c)(1),
(2), (4) Date: Jul. 8, 2002

(87) PCT Pub. No.: WO02/38830

PCT Pub. Date: May 16, 2002

(65) Prior Publication Data

US 2003/0129442 A1 Jul. 10, 2003

(30) Foreign Application Priority Data

Nov. 8, 2000 (JP) ..... 2000-340447
Mar. 21, 2001 (JP) ..... 2001-081095

(51) Int. Cl.[7] ..... B32B 15/00; C23C 22/07

(52) U.S. Cl. ..... 428/648; 148/259; 148/261; 428/600; 428/601; 428/682; 428/219; 428/469; 428/472.3

(58) Field of Search ..... 428/648, 682, 428/600, 601, 219, 469, 472.3; 148/259, 261

(56) References Cited

FOREIGN PATENT DOCUMENTS

JP 4-346676 12/1992

*Primary Examiner*—Robert R. Koehler
(74) *Attorney, Agent, or Firm*—Young & Thompson

(57) ABSTRACT

A surface treated tin-plated steel sheet which has an alloy layer formed on the surface of a steel sheet, a tin plating layer being formed on said alloy layer with a remaining exposed portion of the alloy layer having an area of 30% or more of that of the alloy layer and, formed on said tin plating layer and said exposed portion of the alloy layer, a coating film containing P and Si in an amount of 0.5 to 100 mg/m2 and 0.1 to 250 mg/m2, respectively; and a chemical treatment solution for use in preparing the steel sheet which comprises a phosphate ion, a tin ion and a silane coupling agent and has a pH of 1.5 to 5.5. The surface treated tin-plated steel sheet is free from chromium which causes problems from an environmental view point, and also is excellent in adhesion with a paint, corrosion resistance after being coated, rust resistance, and formability.

8 Claims, No Drawings

SURFACE TREATED TIN-PLATED STEEL SHEET AND SURFACE TREATMENT SOLUTION

TECHNICAL FIELD

The present invention relates to surface-treated tin-plated steel sheets having superior paint-adhesion characteristics, corrosion resistance after coating, antirust properties, and workability, and relates to surface treatment solutions for imparting the above-mentioned properties to steel sheets. These surface-treated tin-plated steel sheets are suitably used for DI (drawn and ironed) cans, food-cans, beverage-cans, and the like.

BACKGROUND ART

Tin-plated steel sheets have been widely used as surface-treated steel sheets used for cans. Generally, after tin plating is performed on cold-rolled steel sheets, these tin-plated steel sheets are immersed or electrolyzed in a dichromic acid solution. The immersion treatment or the electrolytic treatment is called chemical conversion treatment and it forms a chromium oxide layer on the tin-plated layer. The chromium oxide film thus formed prevents the growth of Sn oxide and functions to improve adhesion to paint provided thereon and antirust properties.

However, in view of recent environmental conservation measures, restrictions are being increasingly placed on the use of chromium in various industrial fields, and surface-treated steel sheets for cans have also been increasingly required to be chromium-free.

Chromium-free techniques applied to surface-treated tin-plated steel sheets for cans have been disclosed in, for example, the following patents. In Japanese Examined Patent Application Publication No. 55-24516, a method is disclosed in which a chemical conversion film containing no chromium is formed on a tin-plated steel sheet by performing DC electroplating in a solution primarily containing phosphoric acid using the tin-plated steel sheet as a cathode. In Japanese Examined Patent Application Publication No. 1-32308, an electrolytic tin-plated steel sheet which is provided with a chemical conversion film containing phosphorus (P) and/or aluminum (Al) on the tin-plated layer and which is used for seamless cans containing no chromium (Cr) is disclosed.

Furthermore, in Japanese Examined Patent Application Publication No. 58-41352, a chemical conversion solution, which is used for treating metal surfaces, containing tin ions and at least one of phosphate ions, chlorate ions, and bromate ions and having a pH of 3 to 6 is disclosed.

However, when properties, such as paint-adhesion characteristics and antirust properties, are considered together, the chemical conversion films described in the publications or films obtained by the chemical conversion method described above cannot be sufficiently superior to the chemical conversion film obtained by using a conventional dichromatic acid solution.

As requirements for the surface-treated steel sheets for cans, in addition to the chromium-free techniques, cost-reduction of surface-treated steel sheets as a starting material for cans has also been requested. In particular, since the tin used in tin-plated steel sheets is an expensive metal, reduction in the coating weight of tin formed by plating has been attempted.

However, because tin has superior lubricative properties, when the coating weight of tin formed by plating is reduced, the workability of the steel sheet is decreased, and hence, the coating weight by which tin can be reduced has been limited to a certain level.

In addition, in the case of the conventional tin-plated steel sheets, a chromium oxide film formed on the tin-plated layer advantageously serves to improve the corrosion resistance. However, since the chromium oxide film itself is a hard film, when the coating weight of tin obtained by plating is reduced, galling is likely to occur in a can-forming step. Accordingly, in order to maintain the workability, the coating weight of tin cannot be decreased, and as a result, a film having the most preferable composition has not always been created.

An object of the present invention is to provide a tin-plated steel sheet at an inexpensive cost, which does not contain unfavorable chromium in view of environment conservation and which has superior paint-adhesion characteristics, corrosion resistance after coating, antirust properties, and workability. In addition, the present invention also provides a surface treatment solution, which does not contain Cr, for forming the tin-plated steel sheets described above.

DISCLOSURE OF INVENTION

A surface-treated tin-plated steel sheet of the present invention comprises (1) an alloy layer on a surface of a steel sheet, (2) a tin-plated layer which is provided on the alloy layer so that the alloy layer is exposed at an areal rate of 3.0% or more; and (3) a film comprising P and Si as coating weight of 0.5 to 100 $mg/m^2$ and 0.1 to 250 $mg/m^2$, respectively, provided on the exposed portions of the alloy layer and the tin-plated layer.

The film of the surface-treated tin-plated steel sheet described above preferably further comprises Sn in addition to the predetermined coating weight of the P and the Si described above.

In both of the surface-treated tin-plated steel sheets described above, the Si in the film is preferably derived from a silane coupling agent having an epoxy group.

Each of the surface-treated tin-plated steel sheets described above, the alloy layer is preferably at least one selected from the group consisting of a Fe—Sn alloy layer, a Fe—Ni alloy layer, and a Fe—Sn—Ni alloy layer. In particular, it is more preferable that the alloy layer be a composite alloy layer comprising a Fe—Ni alloy layer having a ratio Ni/(Fe+Ni) of 0.02 to 0.50 on a mass basis and a Fe—Sn—Ni alloy layer provided thereon.

Each of the surface-treated tin-plated steel sheets described above, the coating weight of the tin plating is preferably in the range of 0.05 to 2.0 $g/m^2$.

Furthermore, the present invention provides a chemical conversion solution which contains phosphate ions, tin ions, and a silane coupling agent, and which has a pH of 1.5 to 5.5. The silane coupling agent preferably comprises an epoxy group.

BEST MODE FOR CARRYING OUT THE INVENTION

Hereinafter, the present invention will be described in detail.

When a chemical conversion film containing no Cr is formed on a tin-plated steel sheet by a conventional technique, both paint-adhesion characteristics and corrosion-resistance, which are the major properties required for the steel sheets for cans, are difficult to obtain.

Accordingly, the inventors of the present invention made intensive research in order to solve the problems of the tin-plated steel sheets described above. As a result, the inventors discovered that when a steel sheet was tin-plated so that parts of an alloy layer on the steel sheet are exposed to the surface and was then processed by immersion treatment or electrolytic treatment using a chemical conversion solution composed of an acidic solution containing phosphate ions and tin ions and a silane coupling agent added to the acidic solution, superior paint-adhesion characteristics, corrosion resistance, and workability could be obtained.

Based on the discovery described above, the inventors of the present invention made further detailed research. Consequently, as the alloy layer mentioned above, it was found that at least one alloy layer selected from the group consisting of a Fe—Sn alloy layer, a Fe—Ni alloy layer, and a Fe—Sn—Fe alloy layer was preferable. In addition, it was also found that when a chemical conversion film containing an appropriate coating weight of P and Si was formed on the tin-plated steel sheet and on exposed portions of this alloy layer, superior workability and adhesion to a paint applied to the inside of cans could be obtained. In the case described above, it was discovered that this chemical conversion film was preferably a composite film composed of a phosphate film and a silane film formed by dehydrating condensation of silanol groups. In addition, it was also discovered that when a silane coupling agent was dissolved in an acidic solution containing phosphate ions, a silane coupling agent having an epoxy group was particularly preferable since it could be more homogeneously dissolved than any other silane coupling agents and had superior stability.

The inventors of the present invention made the present invention from the considerations described below based on the results obtained from the above research.

(1) A phosphate film constituting the chemical conversion film, which is formed on the exposed portions of the alloy layer and the tin-plated layer described above, has an anchor effect which improves the paint-adhesion characteristics.

(2) The silanol groups generated from the silane coupling agent perform dehydrating condensation on both surfaces of the exposed portions of the alloy layer and the tin-plated layer (metal tin), and as a result, a silane film is formed. This silane film forms a composite chemical conversion film together with the phosphate film described above. In the step described above, even though this silane film has a small effect of improving the paint-adhesion characteristics, when the composite chemical conversion film is formed together with the phosphate film, superior paint-adhesion characteristics can be obtained. In particular, even though the dehydrating condensation of the silanol groups occurs on the surface of the tin-plated steel sheet, this condensation is more likely to occur on the exposed portions of the alloy layer, and as a result, the effect of improving the paint-adhesion characteristics is primarily obtained by the exposed portions of the alloy layer than the tin-plated layer.

(3) When the alloy layer forms a dense layer, the phosphate film formed thereon also becomes a dense layer. In addition, since reaction points at which the silanol groups perform dehydrating condensation are increased, the concentration of functional group provided on the upper surface is increased, and as a result, the effect of improving the paint-adhesion characteristics can be obtained.

(4) Some of silane materials form a film composed of oligomers thereof by self-condensation, and this film suppresses a cathode reaction which occurs during corrosion under a paint layer, thereby the corrosion resistance after painting can be improved.

Next, the configuration of the present invention will be described.

The surface-treated tin-plated steel sheet of the present invention may have at least one surface which is treated in accordance with the procedure described in the present invention.

In addition, the "tin-plated steel sheet" in the present invention means every steel sheet having a tin-plated layer thereon and an alloy layer provided therebetween. As a preferable "tin-plated steel sheet", for example, there may be mentioned a steel sheet having a tin-plated layer formed on a single alloy layer, such as a Fe—Sn—Ni alloy layer, a Fe—Ni alloy layer, or a Fe—Sn alloy layer, or a steel sheet having a tin-plated layer formed on a composite alloy layer, such as a Fe—Sn—Ni alloy layer provided on a Fe—Ni alloy layer.

When the alloy layer is a single layer, such as a Fe—Sn—Ni alloy layer or a Fe—Sn alloy layer, as described above, the paint-adhesion characteristics and the corrosion resistance after painting tend to be superior. The reason for this is that since the crystals of both alloy layers are dense and continuous, the phosphate film and the silane film formed thereon can also be dense and continuous. Accordingly, it is believed that superior paint-adhesion characteristics and corrosion resistance after painting can be obtained.

In addition, when the alloy layer is a composite alloy formed of a Fe—Sn—Ni alloy layer provided on a Fe—Ni alloy layer, the underlying layer, i.e., the Fe—Ni alloy layer, preferably has a ratio Ni/(Fe+Ni) of 0.02 to 0.50 on a mass basis. The reason for this is that the crystals of the upper layer, i.e., the Fe—Sn—Ni alloy layer, formed during reflow can be dense and continuous, and in addition, the ratio described above is most preferable to obtain the corrosion resistance of the steel sheet itself. That is, when the ratio Ni/(Fe+Ni) on a mass basis is 0.02 to 0.50, areas of voids formed in the Fe—Sn—Ni alloy layer are small, so that the corrosion resistance is improved. In addition, since the silane film is also likely to be continuously formed, the effect of improving the paint-adhesion characteristics can be obtained. The ratio, Ni/(Fe+Ni), on a mass basis can be obtained by the steps of measuring Fe and Ni in the depth direction using $\mu$-AES (Auger electron spectroscopy), integrating the products of individual peak values and the associated relative sensitivity coefficient with respect to the depth, and calculating from the integrated Ni value/(the integrated Ni value+the integrated Fe value).

In the surface-treated tin-plated steel sheet of the present invention, the coating weight of plated tin is preferably 0.05 to 2.0 g/m$^2$. The reason for this is that when the coating weight is 0.05 g/m$^2$ or more, the antirust properties tend to be superior. On the other hand, when the coating weight is more than 2.0 g/m$^2$, the advantage in cost cannot be obtained. The coating weight of plated Sn can be measured by a coulometric method or a surface analytical method using fluorescent x-rays.

Next, in the present invention, after tin plating is performed on a steel sheet, the alloy layer described above must be exposed at an areal rate of 3% or more to the surface of the tin-plated layer. When the areal rate of the exposed portions of the alloy layer is 3.0% or more, the paint-adhesion characteristics is improved. The reason for this has not been clearly understood; however, it is believed that the exposed portion of the alloy layer itself has an anchor effect which improves the paint-adhesion characteristics, and that when the areal rate of the exposed portions of the alloy layer is less than 3.0%, a sufficient anchor effect may be difficult to obtain. In addition, a preferable upper limit of the areal rate of the exposed portions of the alloy layer is approximately 50% in consideration of the antirust properties obtained by the tin-plated layer itself. The areal rate is more preferably 30% or less. In addition, it is naturally understood that areas at which the alloy layer is not exposed are covered with the tin-plated layer (metal Sn layer). The areal rate of the exposed portions of the alloy layer of the present invention on the surface of the tin-plated layer can be measured by a scanning electron microscopic (SEM) method or an electron probe microanalytical (EPMA) method described below.

SEM Method (1) The observation is performed using a scanning electron microscope (SEM). In this step, the magnification is set to 2,000 times, the sample is inclined by 15°, and the locations of grain crystal portions are observed (for example, in the case of a Fe—Sn alloy layer, the acicular crystals are observed).

(2) Next, the sample angle is set to 0°, the magnification is set to 2,000 times, a picture of a surface having an area of 4 $\mu$m×4 $\mu$m of a steel sheet is taken, and the area of the grain crystal portions observed in the above (1) is obtained. Subsequently, the area thus obtained is divided by the total area (16 $\mu m^2$), thereby obtaining the areal rate of the portions of the alloy layer exposed to the surface. The observation and calculation described above are performed for 10 different views, and the average of the areal rate is obtained.

EPMA Method

By a mapping method of EPMA, an area other than the area (corresponding to metal Sn) in which only Sn exists is measured on the surface of the steel sheet having an area of 4 $\mu$m×4 $\mu$m and is then divided by the total area (16 $\mu m^2$), thereby obtaining the areal rate of the exposed portions of the alloy layer. The observation and the calculation described above are performed for 10 different views, and the average of the areal rate of the exposed portions of the alloy layer is obtained.

Three methods for forming alloy layers, that is, (i) a method for forming a composite alloy layer composed of a Fe—Ni—Sn alloy layer provided on a Fe—Ni alloy layer, (ii) a method for forming a Fe—Ni—Sn alloy layer as a single layer, and (iii) a method for forming a Fe—Sn alloy layer as a single layer, will be particularly described.

(i) In the case in which the alloy layer is a composite alloy layer composed of a Fe—Ni—Sn alloy layer as an upper layer and a Fe—Ni alloy layer as a lower layer.

Formation of Fe—Ni Alloy Layer (A) After Ni plating is performed on the surface of a steel sheet, a method for diffusing the entire Ni-plated layer into the steel by heat treatment in a nonoxidizing atmosphere;

(B) after Fe—Ni alloy-plating is performed on the surface of a steel sheet, a method for diffusing a part or the entirety of the Fe—Ni alloy-plated layer into the steel by heat treatment in a nonoxidizing atmosphere; or (C) a method for performing Fe—Ni alloy plating on the surface of a steel sheet;

is performed alone or in combination of at least two methods described above, whereby a Fe—Ni alloy layer can be formed.

Formation of Fe—Sn—Ni Alloy Layer

After the Fe—Ni alloy layer described above is formed, tin plating is performed so as to deposit a predetermined amount, heat-melting treatment is performed, and as a result, a Fe—Sn—Ni alloy layer can be formed. In the step described above, tin that does not form the alloy remains as a metal Sn layer and exists on the Fe—Sn—Ni alloy layer. For example, when a Fe—Ni alloy layer is formed, Ni plating is performed at a coating weight of 30 to 140 mg/m$^2$on a steel sheet by an electroplating method, and annealing is then performed in an atmosphere of 1 to 12 vol % of $H_2$ and 88 to 99 vol % of $N_2$ at a rate of increase in temperature of 20 to 30° C./second, at a maximum temperature of 700° C. for a maximum holding time of 20 to 30 seconds, and at a cooling rate of 10 to 20° C./second. By using the method described above, the ratio, Ni/(Fe+Ni), on a mass basis can be controlled in a range of 0.02 to 0.50. Subsequently, on the steel sheet, 0.05 to 10.0 g/m$^2$ of tin is formed by plating, and heating is performed at a temperature equivalent to or more than the melting point of tin by applying electricity. By the method described above, a Fe—Sn—Ni alloy layer having a dense layer can be formed.

(ii) In the case in which the alloy layer is a single layer composed of a Fe—Sn—Ni alloy layer.

After Ni plating is performed on a steel sheet at a coating weight of 1 to 300 mg/m$^2$, a tin-plated layer is provided, and heating is then performed at a temperature equivalent to or more than the melting point of tin by applying electricity, thereby forming a Fe—Sn—Ni alloy layer.

(iii) In the case in which the alloy layer is a single layer composed of a Fe—Sn alloy layer.

Sn plating is performed on a steel sheet, and heating is then performed at a temperature equivalent to or more than the melting point of tin by applying electricity, thereby forming a Fe—Sn alloy layer.

Next, in the present invention, a film (hereinafter referred to as a chemical conversion film in some cases) containing P as a coating weight of 0.5 to 100 mg/m$^2$ and Si as a coating weight of 0.1 to 250 mg/m$^2$ is formed on the exposed portions of the alloy layer and tin-plated layer described above. In addition, the film described above preferably further contains Sn. Furthermore, the Si contained in the film is preferably Si derived from a silane coupling agent having an epoxy group. These films are preferably formed by using a chemical conversion solution containing P, Sn, and a silane coupling agent.

(I) In the present invention, the coating weight of P in the film is in the range of 0.5 to 100 mg/m$^2$.

The reason for this is that when the coating weight of P is 0.5 mg/m$^2$ or more, the paint-adhesion characteristics can be satisfactory obtained. In addition, when the coating weight is 100 mg/m$^2$ or less, defects are unlikely to be generated in the film, and the paint-adhesion characteristics and the corrosion resistance are improved. The measurement of the coating weight of P was performed by a surface analysis using fluorescent x-rays.

In addition, when a film containing P is formed, a chemical conversion solution is preferably used which is formed by mixing a solution containing Sn ions, such as stannous chloride, stannic chloride, or stannous sulfate, with a solution containing phosphate ions, such as an aqueous solution containing a phosphate salt, e.g., sodium phosphate, aluminum phosphate, or potassium phosphate, or containing a monohydrogen phosphate salt. An insoluble and most stable film (phosphate film) can be formed on the exposed portions of the alloy layer and the tin-plated layer by immersion treatment, electrolytic treatment, or roll coating treatment using this chemical conversion solution.

(II) In the present invention, the coating weight of Si in the film is in the range of 0.1 to 250 mg/m$^2$.

When the coating weight of Si is 250 mg/m$^2$ or less, since water is difficult to be adsorbed by unreacted silanol groups, the paint-adhesion characteristics (secondary adhesion characteristics) can be satisfactory obtained after retort treatment (vapor treatment at 120° C.), and hence, peeling of the coated film can be prevented. In addition, when the coating weight is 0.1 mg/m$^2$ or more, sufficient paint-adhesion characteristics and corrosion resistance can be obtained.

When a silane coupling agent is further added to a solution containing phosphate ions and tin ions, a predetermined amount of silanol groups or silane compounds, which are derived from the silane coupling agent, can be formed in the film.

The chemical formula of a general silane coupling agent is represented by $RSi(—X)(—OR')_2$ or $XSi(—OR'')_3$. In the formulas, R, R', and R" represent alkyl groups, and they may be equal to each other or may be different from each other. In addition, X represents a monovalent substituent and is preferably a substituent having an epoxy group such as a 2-(3,4-epoxycyclohexyl)ethyltrimethoxy group or a 3-glycidoxypropyltrimethoxy group. The reasons for this are that these can be homogeneously dissolved in a phosphoric acid-based solution and that the effect, of improving the paint-adhesion characteristics and the corrosion resistance can be increased. In addition, when an epoxy-based silane coupling agent is used, the compatibility and the reactivity with an epoxy-based paint used inside the can are superior, and hence, the paint-adhesion characteristics are particularly superior.

In addition, in the surface-treated tin-plated steel sheet of the present invention, the ratio on a mass basis of the coating weight of Si to the coating weight of P in the film is preferably in the range of 0.05 to 100 in order to form the most stable phosphate film. When the ratio described above is set to 0.05 to 100, the corrosion resistance, the paint-adhesion characteristics, and the lubricity can be imparted to the film itself, and in addition, the workability can also be improved. When the ratio described above is 0.05 or more, the ratio of the silane film to the phosphate film is high, and hence, the effect of improving the paint-adhesion characteristics is significant. In addition, when the ratio described above is 100 or less, the ratio of the silane film in the chemical conversion film is decreased, and hence, the secondary adhesion characteristics are not adversely influenced. The measurement of the coating weight of Si can be performed by a surface analysis using fluorescent x-rays.

Next, a chemical conversion solution used for forming the chemical conversion film of the surface-treated tin-plated steel sheet of the present invention will be described.

The present invention also provides a chemical conversion solution which contains phosphate ions, tin ions, and a silane coupling agent, and which has a pH of 1.5 to 5.5. The reasons the pH of the chemical conversion solution is controlled in the range of 1.5 to 5.5 are that the silane coupling agent can be homogeneously dissolved in the chemical conversion solution and superior paint-adhesion characteristics can be obtained.

In addition, as described in the present invention, when chemical conversion treatment is performed using the mixed solution described above containing phosphate ions, tin ions, and a silane coupling agent on a Sn-plated layer, the effect of improving the paint-adhesion characteristics can be further improved compared to the case in which a silane coupling agent is only used. That is, it is believed that the improvement in paint-adhesion characteristics can be obtained due to a multiple effect of the anchor effect of the phosphate salts, the compatibility with a coated film caused by the silane coupling agent, and/or the effect of improving the reactivity. In addition, the silanol groups derived from the silane coupling agent react on both of the exposed surface of the alloy layer and the surface of the tin layer. Accordingly, it is believed that when the alloy layer is dense and continuous, an even more significant effect of improving the adhesion can be obtained.

In order to form the chemical conversion film of the present invention, the temperature for drying the chemical conversion solution is preferably in the range of 50 to 130° C. When the drying temperature is 50° C. or more, since the dehydrating condensation reaction between —OH groups on the surface of the steel sheet and the silanol groups derived from the silane coupling agent is likely to occur, a chemical conversion film containing silane compounds is preferably formed. In addition, when the drying temperature is 130° C. or less, discoloration of Sn plating can be suppressed.

As described above, in the present invention, the chemical conversion film having the composition in the appropriate range described above, which is formed of the chemical conversion solution containing P, Sn, and the silane coupling agent, is provided on the tin-plated layer formed on the surface of the steel sheet. In more particular, it is important to optimize the pH and the silane coupling agent in the chemical conversion solution. In addition, it is more preferable that, for example, the layer such as a Fe—Sn—Ni alloy layer or a Fe—Sn alloy layer, which is partly exposed to the surface, be dense and continuous. By providing the chemical conversion film described above on the above-mentioned layer, the inventors of the present invention succeeded in obtaining paint-adhesion characteristics and corrosion resistance equivalent to those obtained by a conventional dichromic acid treatment. In addition, since this surface-treated tin-plated steel sheet of the present invention does not use a hard chromium layer, superior workability can be obtained.

Next, a particular example of a method for manufacturing a surface-treated tin-plated steel sheet of the present invention will be described.

Ni plating is performed on a steel sheet by electroplating. Next, this Ni-plated steel sheet is annealed in a mixed gas atmosphere of 10 vol % of $H_2$ and 90 vol % of $N_2$, at a rate of, increase in temperature of 25° C./second, at a maximum temperature of 700° C. for a maximum holding time of 25 seconds, and a cooling rate of 15° C./second so that the Ni is diffused into the steel sheet, thereby forming a Fe—Ni alloy layer. Furthermore, after skin pass rolling of approximately 1%, electrolytic degreasing, and picking are performed, tin plating is then performed by an electroplating method. Subsequently, the steel sheet thus treated is heat-melted at a temperature equivalent to or more than the melting point of tin by applying electricity, thereby forming a Fe—Sn—Ni alloy layer. In the step described above, tin that does not form the alloy remains as a tin-plated layer. Next, after a cathode treatment at 1 C/dm$^2$ is performed in a sodium carbonate aqueous solution at a concentration of 15 g/l, a chemical conversion treatment is performed by a known method, such as an immersion, an electroplating, a spray, or a roll-coating method, thereby forming a surface-treated tin-plated steel sheet.

In the step described above, as the chemical conversion solution, a solution is preferably used which is composed of a silane coupling agent and an aqueous solution containing a metal salt, such as phosphoric acid, sodium phosphate, aluminum phosphate, or potassium phosphate, and/or a monohydrogen phosphate salt or the like at a concentration of 1 to 80 g/l in the form of phosphate ions; and stannous chloride, stannic chloride, and/or stannous sulfate or the like at a concentration of 0.001 to 10 g/l in the form of tin ions. In the step described above, an oxidizer such as sodium chlorate may be added as an accelerant. As the silane coupling agent described above, 2-(3,4-epoxycyclohexyl) ethyltrimethoxy silane or a 3-glycidoxypropyltrimethoxy silane at a preferable concentration of 0.1 to 5.0 wt % is added and is dissolved so that a solution has a pH of 1.5 to 5.5. For adjusting pH, sodium hydroxide, potassium hydroxide, or the like may be used.

The reason the preferable concentration range in the form of phosphate ions in the chemical conversion solution is set to 1 to 80 g/l is that when the concentration is 1 g/l or more, the paint-adhesion characteristics and the corrosion resistance are superior. In addition, when the concentration is 80 g/l or less, defects in the chemical conversion film are unlikely to be formed, and hence, the paint-adhesion characteristics and the corrosion resistance can be improved. Furthermore, unreacted phosphoric acid is unlikely to remain, and hence, degradation of paint-adhesion characteristics can be suppressed.

In addition, the reason the preferable concentration range in the form of tin ions in the chemical conversion solution is set to 0.001 to 10 g/l is that when the concentration is 0.001 g/l or more, the corrosion resistance tends to be improved. In addition, when the concentration is 10 g/l or less, the stability of the conversion solution can be easily maintained.

Furthermore, the reason the preferable range of the addition amount of the silane coupling agent is set to 0.1 to 5.0 wt % in the chemical conversion solution is that when the addition amount is 0.1 wt % or more, the effect of improving the paint-adhesion characteristics can be obtained. In addition, when the addition amount is 5.0 wt % or less, the paint-adhesion characteristics are not degraded, and the stability of the chemical conversion solution can be maintained.

Conditions for the chemical conversion treatment are preferably performed at a temperature of the chemical conversion solution of 40 to 60° C. for a treating (immersion) time of 1 to 5 seconds. The tin-plated steel sheet after the immersion treatment is dried by hot wind at a temperature of 50 to 120° C. In order to control the coating weight of the chemical conversion film, roll-drawing may be performed after the steel sheet is immersed in the chemical conversion solution.

While the present invention has been described with reference to preferred embodiments, it is to be understood that the description only showed examples of the embodiments of the present invention, and that various modification can be made within the scope of the claims.

EXAMPLES

Next, examples of the present invention will be described in detail.

Examples 1 to 29

After electrolytic degreasing was performed for original steel sheet T4 having a thickness of 0.22 mm, and Ni plating was then performed at a coating weight of 70 mg/m$^2$, annealing in an atmosphere of 10 vol % of $H_2$ and 90 vol % of $N_2$ was performed at 700° C. so that the Ni-plated layer was diffused into the original steel sheet, whereby a Fe—Ni alloy layer was formed. After rolling for heat treatment was performed at a reduction ratio of 1.5% on this Ni-plated steel sheet, degreasing and pickling were performed, and Sn plating was then performed on the Ni-plated layer. Subsequently, heat-melting treatment was performed at the melting temperature of Sn or more, thereby forming a Fe—Sn—Ni alloy layer. In examples 1 to 27, after cathode treatment was performed at 1 C/dm$^2$ in an aqueous solution containing sodium carbonate at a concentration of 15 g/l, films were formed under the chemical conversion conditions shown in Tables 1 and 2. On the other hand, in examples 28 and 29, films were formed under the chemical conversion conditions shown in Tables 1 and 2 without performing the cathode treatment described above. The Ni plating and the tin plating were performed under the conditions described below.

| Ni Plating Conditions | |
|---|---|
| Nickel sulfate | 250 g/l |
| Nickel chloride | 45 g/l |
| Boric acid | 30 g/l |
| Bath temperature | 50° C. |
| Current density | 5 A/dm$^2$ |
| **Sn Plating Conditions** | |
| Stannous chloride | 55 g/l |
| Phenolsulfonic acid | 20 g/l |
| Bath temperature | 55° C. |
| Current density | 10 A/dm$^2$ |

Examples 30 to 48

After electrolytic degreasing and pickling were performed for original steel sheet T4 having a thickness of 0.22 mm, Sn plating was then performed. Subsequently, after heat-melting treatment was performed at the melting temperature of Sn or more, cathode treatment was performed at 1 C/dm$^2$ in an aqueous solution containing sodium carbonate at a concentration of 15 g/l for samples of examples 30 to 47, and chemical conversion films were then formed under the chemical conversion conditions shown in Table 2. On the other hand, in example 48, a chemical conversion film was formed under the chemical conversion conditions shown in Table 2 without performing the cathode treatment described above. The tin plating was performed under the conditions described below.

| Sn Plating Conditions | |
|---|---|
| Stannous chloride | 55 g/l |
| Phenolsulfonic acid | 20 g/l |
| Bath temperature | 55° C. |
| Current density | 10 A/dm$^2$ |

Comparative Examples 1 to 16

For comparison, surface-treated tin-plated steel sheets provided with chemical conversion films having compositions out of the appropriate range were formed under the conditions shown in Table 3.

Evaluation of Properties

The workability, paint-adhesion characteristics, antirust properties, and corrosion resistance after painting were evaluated for surface-treated tin-plated steel sheets of examples 1 to 48 and comparative examples 1 to 16.

(1) Workability

The workability was evaluated by observing the appearance of a sample whether defects such as wrinkles or galling were formed by draw-ironing. The evaluation results are shown in Tables 4 to 6. In Tables 4 to 6, the case in which defects such as wrinkles or galling were not observed is represented by "B", and the case in which the defects were observed is represented by "D". Draw-ironing was performed under the conditions described below.

Blank diameter: 170 mm

Drawing conditions: a first drawing ratio of 1.8, and a second drawing ratio of 1.3

Draw-ironing diameter: 60 mm in diameter at third stage ironing (2) Paint-Adhesion Characteristics The paint-adhesion characteristics were evaluated by the method described below.

After an epoxy-phenol-based paint was applied at a coating weight of 50 mg/dm$^2$to the surface of the individual tin-plated steel sheets described above, heating at 210° C. was performed for 10 minutes. Next, these two tin-plated steel sheets were laminated to each other so that the paint coated surfaces oppose each other with a nylon-based adhesive film provided therebetween and were then bonded together under the conditions of a pressure of $2.94\times10^5$ Pa, a temperature of 190° C., and a pressure time for 30 seconds. The same paint and the same adhesive film were used for the samples of the individual examples and comparative examples. Subsequently, the sample was divided into ten specimens having widths of 5 mm, T peel strength measurement was performed for the five specimens using a tensile tester, and the average value obtained from the results was used for evaluation of primary paint-adhesion characteristics. In addition, the other five specimens were immersed in a solution containing 1.5 wt % of NaCl and 1.5 wt % of citric acid at 55° C. for 7 days, and secondary paint-adhesion characteristics were evaluated by the average value obtained from the results of T peel strength measured using the tensile tester as described above. The evaluation results are shown in Tables 4 to 6. In Tables 4 to 6, a measurement strength of 68.6 [N] or more per a 5 mm-wide specimen is represented by "A", a measurement strength of 49.0 [N] to less than 68.6 [N] is represented by "B", a measurement strength of 29.4 [N] to less than 49.0 [N] is represented by "C", and a measurement strength of less than 29.4 [N] is represented by "D".

(3) Antirust Properties

The individual surface-treated tin-plated steel sheets described above were alternately exposed for 30 minutes to high-humid conditions at 50° C. and at a relative humidity of 98% and to dry conditions at 25° C. and at a relative humidity of 60%, and the numbers of days for rust to be generated on the steel sheets were measured. The antirust properties were evaluated by the number of days thus measured. The results are shown in Tables 4 to 6. In Tables 4 to 6, the case in which the generation of rust was not observed for 30 days or more is represented by "B", the case in which the generation of rust was observed from 15 days to less than 30 days is represented by "C", and the case in which the generation of rust was observed within 15 days is represented by "D".

(4) Corrosion Resistance After Painting

After an epoxy-phenol-based paint was applied at a coating weight of 50 mg/dm$^2$to the surface of the individual tin-plated steel sheets described above, heating at 210° C. was performed for 10 minutes. Next, the side surfaces and the rear surface of each steel sheet were sealed, the paint coated surface thereof was crosscut, and the steel sheets thus treated were immersed in a solution containing 1.5% of NaCl and 1.5 wt % of citric acid at 55° C. for 4 days. Subsequently, after the samples were washed using water and were then dried, the crosscut portions were peeled using adhesive tapes, and the widths of peeled coated films were measured. The corrosion resistance after coating was evaluated by the width of the peeled coated film. The results are shown in Tables 4 to 6. In Tables 4 to 6, the case in which the width of a peeled film was 0.1 mm or less is represented by "B", the case in which the width was more than 0.1 mm to less than 0.2 mm is represented by "C", and the case in which the width was 0.2 mm or more is represented by "D".

As can be seen in Tables 4 to 6, concerning the samples of examples 1 to 48, the workability, paint-adhesion characteristics, antirust properties, and corrosion resistance after coating were all superior. On the other hand, concerning the samples of comparative examples 1 to 16 in which the compositions of the chemical conversion films were out of the appropriate range of the present invention, at least one of the workability, paint-adhesion characteristics, antirust properties, and corrosion resistance after coating was inferior and was not at a level in practical use.

TABLE 1

| | FILM-FORMING CONDITIONS | | | | | | | |
|---|---|---|---|---|---|---|---|---|
| | CHEMICAL CONVERSION SOLUTION | | | | | | CHEMICAL CONVERSION CONDITIONS | |
| | PHOSPHORIC ACID (g/l) | STANNOUS CHLORIDE (g/l) | SODIUM CHLORATE (g/l) | TYPE OF SILANE COUPLING AGENT *1 | SILANE CONCEN-TRATION (mass %) | pH | SOLUTION TEMPERATURE (° C.) | TREATMENT TIME (seconds) |
| EXAMPLE 1 | 5.78 | 0.55 | 0.57 | A | 1.0 | 4.4 | 50 | 1.0 |
| EXAMPLE 2 | 10.2 | 2.50 | 0.57 | A | 1.0 | 4.4 | 50 | 5.0 |
| EXAMPLE 3 | 10.2 | 2.50 | 0.57 | A | 1.0 | 4.4 | 50 | 10.0 |
| EXAMPLE 4 | 5.78 | 0.55 | 0.57 | A | 1.0 | 4.4 | 50 | 1.0 |
| EXAMPLE 5 | 5.78 | 0.55 | 0.57 | A | 1.0 | 4.4 | 50 | 1.0 |
| EXAMPLE 6 | 5.78 | 0.05 | 0.57 | A | 1.0 | 4.4 | 50 | 1.0 |
| EXAMPLE 7 | 5.78 | 0.10 | 0.57 | A | 1.0 | 4.4 | 50 | 1.0 |
| EXAMPLE 8 | 5.78 | 0.85 | 0.57 | A | 1.0 | 4.4 | 50 | 1.0 |
| EXAMPLE 9 | 9.20 | 2.25 | 0.57 | A | 1.0 | 4.4 | 50 | 1.0 |
| EXAMPLE 10 | 5.78 | 0.55 | 0.57 | A | 0.1 | 4.4 | 50 | 1.0 |

TABLE 1-continued

| | FILM-FORMING CONDITIONS | | | | | | | |
|---|---|---|---|---|---|---|---|---|
| | CHEMICAL CONVERSION SOLUTION | | | | | CHEMICAL CONVERSION CONDITIONS | | |
| | PHOSPHORIC ACID (g/l) | STANNOUS CHLORIDE (g/l) | SODIUM CHLORATE (g/l) | TYPE OF SILANE COUPLING AGENT *1 | SILANE CONCEN-TRATION (mass %) | pH | SOLUTION TEMPERATURE (° C.) | TREATMENT TIME (seconds) |
| EXAMPLE 11 | 5.78 | 0.55 | 0.57 | A | 0.5 | 4.4 | 50 | 1.0 |
| EXAMPLE 12 | 5.78 | 0.55 | 0.57 | A | 3.0 | 4.4 | 50 | 1.0 |
| EXAMPLE 13 | 5.78 | 0.55 | 0.57 | A | 10.0 | 4.4 | 50 | 1.0 |
| EXAMPLE 14 | 5.78 | 0.55 | 0.57 | A | 20.0 | 4.4 | 50 | 1.0 |
| EXAMPLE 15 | 5.78 | 0.55 | 0.57 | B | 1.0 | 4.4 | 50 | 1.0 |
| EXAMPLE 16 | 5.78 | 0.55 | 0.57 | A | 1.0 | 4.4 | 50 | 1.0 |
| EXAMPLE 17 | 5.78 | 0.55 | 0.57 | A | 1.0 | 2.0 | 50 | 1.0 |
| EXAMPLE 18 | 5.78 | 0.55 | 0.57 | A | 1.0 | 5.2 | 50 | 1.0 |
| EXAMPLE 19 | 5.78 | 0.55 | 0.57 | C | 1.0 | 4.4 | 50 | 1.0 |
| EXAMPLE 20 | 5.78 | 0.55 | 0.57 | D | 1.0 | 4.4 | 50 | 1.0 |
| EXAMPLE 21 | 5.78 | 0.55 | 0.57 | A | 1.0 | 4.4 | 50 | 1.0 |
| EXAMPLE 22 | 5.78 | 0.55 | 0.57 | A | 1.0 | 4.4 | 50 | 1.0 |
| EXAMPLE 23 | 5.78 | 0.55 | 0.57 | A | 1.0 | 4.4 | 50 | 1.0 |
| EXAMPLE 24 | 5.78 | 0.55 | 0.57 | A | 1.0 | 4.4 | 50 | 1.0 |

(NOTE)
*1: A IS 3-GLYCIDOXYPROPYLTRIMETHOXYSILANE (EPOXY-BASED SILANE).
B IS 2-(3,4-EPOXYCYCLOHEXYL) ETHYLTRIMETHOXYSILANE (EPOXY-BASED SILANE).
C IS N-2-(AMINOETHYL) 3-AMINOPROPYLTRIMETHOXYSILANE (AMINE-BASED SILANE).
D IS VINYLTRIETHOXYSILANE.

TABLE 2

| | FILM-FORMING CONDITIONS | | | | | | | |
|---|---|---|---|---|---|---|---|---|
| | CHEMICAL CONVERSION SOLUTION | | | | | CHEMICAL CONVERSION CONDITIONS | | |
| | PHOSPHORIC ACID (g/l) | STANNOUS CHLORIDE (g/l) | SODIUM CHLORATE (g/l) | TYPE OF SILANE COUPLING AGENT *1 | SILANE CONCEN-TRATION (mass %) | pH | SOLUTION TEMPERATURE (° C.) | TREATMENT TIME (seconds) |
| EXAMPLE 25 | 5.78 | 0.55 | 0.57 | A | 1.0 | 4.4 | 50 | 1.0 |
| EXAMPLE 26 | 5.78 | 0.55 | 0.57 | A | 1.0 | 4.4 | 50 | 1.0 |
| EXAMPLE 27 | 5.78 | 0.55 | 0.57 | A | 1.0 | 4.4 | 50 | 1.0 |
| EXAMPLE 28 | 5.78 | 0.55 | 0.57 | A | 1.0 | 4.4 | 50 | 1.0 |
| EXAMPLE 29 | 7.80 | 0.70 | 0.70 | A | 30.0 | 3.6 | 60 | 60.0 |
| EXAMPLE 30 | 5.78 | 0.55 | 0.57 | A | 1.0 | 4.4 | 50 | 1.0 |
| EXAMPLE 31 | 5.78 | 0.55 | 0.57 | A | 1.0 | 4.4 | 50 | 1.0 |
| EXAMPLE 32 | 5.78 | 0.55 | 0.57 | A | 1.0 | 4.4 | 50 | 8.0 |
| EXAMPLE 33 | 5.78 | 0.55 | 0.57 | A | 1.0 | 4.4 | 50 | 25.0 |
| EXAMPLE 34 | 5.78 | 0.55 | 0.57 | A | 1.0 | 4.4 | 50 | 1.0 |
| EXAMPLE 35 | 5.78 | 0.55 | 0.57 | A | 1.0 | 4.4 | 50 | 1.0 |
| EXAMPLE 36 | 4.0 | 0.35 | 0.39 | A | 1.0 | 4.4 | 50 | 1.0 |
| EXAMPLE 37 | 4.0 | 0.35 | 0.39 | A | 1.0 | 4.4 | 50 | 1.0 |
| EXAMPLE 38 | 4.0 | 0.35 | 0.39 | A | 1.0 | 4.4 | 50 | 1.0 |
| EXAMPLE 39 | 4.0 | 0.35 | 0.39 | A | 1.0 | 4.4 | 50 | 1.0 |
| EXAMPLE 40 | 6.0 | 0.35 | 0.39 | A | 1.0 | 4.4 | 50 | 3.0 |
| EXAMPLE 41 | 6.0 | 0.35 | 0.39 | A | 1.0 | 4.4 | 50 | 10.0 |
| EXAMPLE 42 | 15.0 | 0.80 | 0.39 | A | 1.0 | 4.4 | 50 | 20.0 |
| EXAMPLE 43 | 4.0 | 0.35 | 0.39 | A | 0.1 | 4.4 | 50 | 0.5 |
| EXAMPLE 44 | 4.0 | 0.35 | 0.39 | A | 0.3 | 4.4 | 50 | 1.0 |
| EXAMPLE 45 | 4.0 | 0.35 | 0.39 | A | 0.5 | 4.4 | 50 | 1.0 |
| EXAMPLE 46 | 4.0 | 0.35 | 0.39 | A | 12.0 | 4.4 | 50 | 1.0 |
| EXAMPLE 47 | 4.0 | 0.35 | 0.39 | A | 25.0 | 4.4 | 50 | 1.0 |
| EXAMPLE 48 | 5.78 | 0.55 | 0.57 | A | 1.0 | 4.4 | 50 | 1.0 |

(NOTE)
*1: A IS 3-GLYCIDOXYPROPYLTRIMETHOXYSILANE (EPOXY-BASED SILANE).

TABLE 3

| | FILM-FORMING CONDITIONS | | | | | | | |
|---|---|---|---|---|---|---|---|---|
| | CHEMICAL CONVERSION SOLUTION | | | | | CHEMICAL CONVERSION CONDITIONS | | |
| | PHOSPHORIC ACID (g/l) | STANNOUS CHLORIDE (g/l) | SODIUM CHLORATE (g/l) | TYPE OF SILANE COUPLING AGENT *1 | SILANE CONCENTRATION (mass %) | pH | SOLUTION TEMPERATURE (° C.) | TREATMENT TIME (seconds) |
| COMPARATIVE EXAMPLE 1 | 5.78 | 0.55 | 0.57 | A | 1.0 | 4.4 | 50 | 0.2 |
| COMPARATIVE EXAMPLE 2 | 5.78 | 0.55 | 0.57 | A | 1.0 | 4.4 | 50 | 20.0 |
| COMPARATIVE EXAMPLE 3 | 5.78 | 0.55 | 0.57 | A | 0.05 | 4.4 | 50 | 1.0 |
| COMPARATIVE EXAMPLE 4 | 5.78 | 0.55 | 0.57 | A | 30.0 | 4.4 | 50 | 1.0 |
| COMPARATIVE EXAMPLE 5 | 5.78 | 0.55 | 0.57 | A | 1.0 | 1.4 | 50 | 1.0 |
| COMPARATIVE EXAMPLE 6 | 5.78 | 0.55 | 0.57 | A | 1.0 | 6.0 | 50 | 1.0 |
| COMPARATIVE EXAMPLE 7 | ELECTROLYTIC TREATMENT USING DICHROMATE ($Na_2Cr_2O_7$: 30 mass %, TEMPERATURE: 50° C., pH4.0, CURRENT DENSITY 4.5 C/dm$^2$, TREATMENT TIME 1.5 SECONDS) | | | | | | | |
| COMPARATIVE EXAMPLE 8 | ELECTROLYTIC TREATMENT USING DICHROMATE ($Na_2Cr_2O_7$: 30 mass %, TEMPERATURE: 50° C., pH4.0, CURRENT DENSITY 4.5 C/dm$^2$, TREATMENT TIME 2.0 SECONDS) | | | | | | | |
| COMPARATIVE EXAMPLE 9 | NO CHEMICAL CONVERSION TREATMENT | | | | | | | |
| COMPARATIVE EXAMPLE 10 | 5.78 | 0.55 | 0.57 | A | 1.0 | 4.4 | 50 | 0.3 |
| COMPARATIVE EXAMPLE 11 | 11.0 | 1.25 | 0.57 | A | 1.0 | 4.4 | 50 | 35.0 |
| COMPARATIVE EXAMPLE 12 | 21.0 | 2.50 | 0.02 | A | 4.0 | 4.4 | 50 | 1.0 |
| COMPARATIVE EXAMPLE 13 | 0.6 | 0.35 | 0.39 | A | 1.0 | 4.4 | 50 | 1.0 |
| COMPARATIVE EXAMPLE 14 | 12.5 | 0.35 | 0.39 | A | 1.0 | 4.4 | 50 | 20.0 |
| COMPARATIVE EXAMPLE 15 | 4.0 | 0.35 | 0.39 | A | 0.01 | 4.4 | 50 | 1.0 |
| COMPARATIVE EXAMPLE 16 | 4.0 | 0.35 | 0.39 | A | 45.0 | 4.4 | 50 | 1.0 |

(NOTE)
*1: A IS 3-GLYCIDOXYPROPYLTRIMETHOXYSILANE (EPOXY-BASED SILANE).

TABLE 4

| | Fe—Ni ALLOY LAYER Ni/(Fe + Ni) RATIO | Fe—Sn—Ni ALLOY LAYER AREAL RATE OF EXPOSED PORTIONS (SEM METHOD) (%) | Fe—Sn ALLOY LAYER SURFACE COVERAGE (SEM METHOD) (%) | Sn PLATED LAYER COATING WEIGHT OF Sn PLATED LAYER BEFORE HEAT-MELTING TREATMENT (g/m$^2$) | Sn PLATED LAYER COATING WEIGHT OF Sn PLATED LAYER AFTER HEAT-MELTING TREATMENT (g/m$^2$) | FILM P COATING WEIGHT (mg/m$^2$) | FILM Si COATING WEIGHT RATIO TO P COATING WEIGHT | FILM Si COATING WEIGHT (mg/m$^2$) |
|---|---|---|---|---|---|---|---|---|
| EXAMPLE 1 | 0.13 | 13 | NO LAYER | 1.0 | 1.5 | 7.0 | 1.43 | 10.1 |
| EXAMPLE 2 | 0.13 | 13 | NO LAYER | 1.0 | 0.5 | 50.0 | 0.20 | 10.0 |
| EXAMPLE 3 | 0.13 | 13 | NO LAYER | 1.0 | 0.5 | 90.0 | 0.11 | 10.0 |
| EXAMPLE 4 | 0.13 | 13 | NO LAYER | 0.6 | 0.5 | 7.0 | 1.43 | 10.0 |
| EXAMPLE 5 | 0.13 | 10 | NO LAYER | 2.0 | 0.5 | 7.0 | 1.43 | 10.0 |
| EXAMPLE 6 | 0.13 | 13 | NO LAYER | 1.0 | 0.5 | 7.0 | 1.43 | 10.0 |
| EXAMPLE 7 | 0.13 | 13 | NO LAYER | 1.0 | 0.5 | 7.0 | 1.43 | 10.0 |
| EXAMPLE 8 | 0.13 | 13 | NO LAYER | 1.0 | 0.5 | 7.0 | 1.43 | 10.0 |
| EXAMPLE 9 | 0.13 | 13 | NO LAYER | 1.0 | 0.5 | 7.0 | 1.43 | 10.0 |
| EXAMPLE 10 | 0.13 | 13 | NO LAYER | 1.0 | 0.5 | 7.0 | 0.086 | 0.6 |
| EXAMPLE 11 | 0.13 | 13 | NO LAYER | 1.0 | 0.5 | 7.0 | 0.29 | 2.0 |
| EXAMPLE 12 | 0.13 | 13 | NO LAYER | 1.0 | 0.5 | 7.0 | 0.71 | 5.0 |
| EXAMPLE 13 | 0.13 | 13 | NO LAYER | 1.0 | 0.5 | 7.0 | 2.86 | 20.0 |
| EXAMPLE 14 | 0.13 | 13 | NO LAYER | 1.0 | 0.5 | 7.0 | 1.43 | 45.0 |
| EXAMPLE 15 | 0.13 | 13 | NO LAYER | 1.0 | 0.5 | 7.0 | 1.43 | 10.0 |
| EXAMPLE 16 | 0.13 | 13 | NO LAYER | 1.0 | 0.5 | 7.0 | 1.43 | 10.0 |

TABLE 4-continued

| | | | | | | | | |
|---|---|---|---|---|---|---|---|---|
| EXAMPLE 17 | 0.13 | 13 | NO LAYER | 1.0 | 0.5 | 9.0 | 1.11 | 10.0 |
| EXAMPLE 18 | 0.13 | 13 | NO LAYER | 0.6 | 0.5 | 5.0 | 2.00 | 10.0 |
| EXAMPLE 19 | 0.25 | 24 | NO LAYER | 1.0 | 0.5 | 7.0 | 1.43 | 10.0 |
| EXAMPLE 20 | 0.08 | 13 | NO LAYER | 1.0 | 0.5 | 7.0 | 1.43 | 10.0 |
| EXAMPLE 21 | 0.03 | 5 | NO LAYER | 1.0 | 0.5 | 7.0 | 1.43 | 10.0 |
| EXAMPLE 22 | 0.13 | 48 | NO LAYER | 1.0 | 0.06 | 7.0 | 1.43 | 10.0 |
| EXAMPLE 23 | 0.13 | 8 | NO LAYER | 1.0 | 1.4 | 7.0 | 1.43 | 10.0 |
| EXAMPLE 24 | 0.6 | 43 | NO LAYER | 1.0 | 0.5 | 7.0 | 1.14 | 8.0 |

| | EVALUATION OF PROPERTIES | | | | |
|---|---|---|---|---|---|
| | WORK-ABILITY | PAINT-ADHESION CHARAC-TERISTICS (PRIMARY) | PAINT-ADHESION CHARAC-TERISTICS (SECONDARY) | ANTI RUST PRO-PER-TIES | CORROSION RESISTANCE AFTER COATING |
| EXAMPLE 1 | B | A | A | B | B |
| EXAMPLE 2 | B | A | B | B | B |
| EXAMPLE 3 | B | A | B | B | B |
| EXAMPLE 4 | B | A | A | B | B |
| EXAMPLE 5 | B | A | A | B | B |
| EXAMPLE 6 | B | A | A | B | B |
| EXAMPLE 7 | B | A | A | B | B |
| EXAMPLE 8 | B | A | A | B | B |
| EXAMPLE 9 | B | A | A | B | B |
| EXAMPLE 10 | B | A | B | B | B |
| EXAMPLE 11 | B | A | A | B | B |
| EXAMPLE 12 | B | A | A | B | B |
| EXAMPLE 13 | B | A | A | B | B |
| EXAMPLE 14 | B | A | B | B | B |
| EXAMPLE 15 | B | A | A | B | B |
| EXAMPLE 16 | B | A | A | B | B |
| EXAMPLE 17 | B | A | A | B | B |
| EXAMPLE 18 | B | A | A | B | B |
| EXAMPLE 19 | B | A | A | B | B |
| EXAMPLE 20 | B | A | A | B | B |
| EXAMPLE 21 | B | A | A | B | B |
| EXAMPLE 22 | B | A | A | B | B |
| EXAMPLE 23 | B | A | A | B | B |
| EXAMPLE 24 | B | B | B | B | B |

TABLE 5

| | | Fe—Sn—Ni ALLOY LAYER | | Sn PLATED LAYER | | FILM | | |
|---|---|---|---|---|---|---|---|---|
| | Fe—Ni ALLOY LAYER Ni/(Fe + Ni) RATIO | AREAL RATE OF EXPOSED PORTIONS (SEM METHOD) (%) | Fe—Sn ALLOY LAYER SURFACE COVERAGE (SEM METHOD) (%) | COATING WEIGHT OF Sn PLATED LAYER BEFORE HEAT-MELTING TREATMENT ($g/m^2$) | COATING WEIGHT OF Sn PLATED LAYER AFTER HEAT-MELTING TREATMENT ($g/m^2$) | P COATING WEIGHT ($mg/m^2$) | Si COATING WEIGHT RATIO TO P COATING WEIGHT | Si COATING WEIGHT ($mg/m^2$) |
| EXAMPLE 25 | 0.01 | 4 | NO LAYER | 1.0 | 0.5 | 3.0 | 0.33 | 1.0 |
| EXAMPLE 26 | 0.13 | 52 | NO LAYER | 1.0 | 0.02 | 5.0 | 3.00 | 15.0 |
| EXAMPLE 27 | 0.13 | 5 | NO LAYER | 1.0 | 0.7 | 4.0 | 0.13 | 0.5 |
| EXAMPLE 28 | 0.13 | 13 | NO LAYER | 1.0 | 0.5 | 7.0 | 1.43 | 10.0 |
| EXAMPLE 29 | 0.13 | 13 | NO LAYER | 1.0 | 0.5 | 7.0 | 31.4 | 220 |
| EXAMPLE 30 | NO LAYER | NO LAYER | 3 | 2.8 | 1.6 | 7.0 | 1.43 | 10.0 |
| EXAMPLE 31 | NO LAYER | NO LAYER | 4 | 5.6 | 2.8 | 7.0 | 1.43 | 10.0 |
| EXAMPLE 32 | NO LAYER | NO LAYER | 3 | 2.8 | 1.6 | 14.0 | 0.71 | 10.0 |
| EXAMPLE 33 | NO LAYER | NO LAYER | 3 | 2.8 | 1.6 | 40.0 | 0.25 | 10.0 |

TABLE 5-continued

| | | | | | | | | |
|---|---|---|---|---|---|---|---|---|
| EXAMPLE 34 | NO LAYER | NO LAYER | 3 | 2.8 | 1.6 | 7.0 | 2.86 | 20.0 |
| EXAMPLE 35 | NO LAYER | NO LAYER | 3 | 2.8 | 1.6 | 7.0 | 0.086 | 0.6 |
| EXAMPLE 36 | NO LAYER | NO LAYER | 3 | 4.0 | 2.0 | 7.0 | 1.43 | 10.0 |
| EXAMPLE 37 | NO LAYER | NO LAYER | 4 | 1.0 | 0.5 | 7.0 | 1.43 | 10.0 |
| EXAMPLE 38 | NO LAYER | NO LAYER | 10 | 0.6 | 0.3 | 7.0 | 1.43 | 10.0 |
| EXAMPLE 39 | NO LAYER | NO LAYER | 45 | 0.3 | 0.15 | 7.0 | 1.43 | 10.0 |
| EXAMPLE 40 | NO LAYER | NO LAYER | 3 | 2.8 | 1.4 | 20.0 | 0.50 | 10.0 |
| EXAMPLE 41 | NO LAYER | NO LAYER | 3 | 3.0 | 1.5 | 40.0 | 0.25 | 10.0 |
| EXAMPLE 42 | NO LAYER | NO LAYER | 3 | 3.0 | 1.5 | 90.0 | 0.11 | 10.0 |
| EXAMPLE 43 | NO LAYER | NO LAYER | 3 | 3.0 | 1.5 | 7.0 | 0.09 | 0.6 |
| EXAMPLE 44 | NO LAYER | NO LAYER | 3 | 3.0 | 1.5 | 7.0 | 0.29 | 2 |
| EXAMPLE 45 | NO LAYER | NO LAYER | 3 | 3.0 | 1.5 | 7.0 | 0.71 | 5 |
| EXAMPLE 46 | NO LAYER | NO LAYER | 3 | 3.0 | 1.5 | 7.0 | 2.86 | 20 |
| EXAMPLE 47 | NO LAYER | NO LAYER | 3 | 3.0 | 1.5 | 7.0 | 6.43 | 45 |
| EXAMPLE 48 | NO LAYER | NO LAYER | 4 | 2.6 | 0.7 | 7.0 | 1.71 | 12.0 |

| | EVALUATION OF PROPERTIES | | | | |
|---|---|---|---|---|---|
| | WORK-ABILITY | PAINT-ADHESION CHARAC-TERISTICS (PRIMARY) | PAINT-ADHESION CHARAC-TERISTICS (SECONDARY) | ANTI RUST PRO-PER-TIES | CORROSION RESISTANCE AFTER COATING |
| EXAMPLE 25 | B | B | B | B | B |
| EXAMPLE 26 | B | B | B | B | B |
| EXAMPLE 27 | B | B | B | B | B |
| EXAMPLE 28 | B | A | A | B | B |
| EXAMPLE 29 | B | A | A | B | B |
| EXAMPLE 30 | B | B | B | B | B |
| EXAMPLE 31 | B | B | B | B | B |
| EXAMPLE 32 | B | B | B | B | B |
| EXAMPLE 33 | B | B | B | B | B |
| EXAMPLE 34 | B | B | B | B | B |
| EXAMPLE 35 | B | B | B | B | B |
| EXAMPLE 36 | B | A | A | B | B |
| EXAMPLE 37 | B | A | A | B | B |
| EXAMPLE 38 | B | A | A | B | B |
| EXAMPLE 39 | B | A | A | B | B |
| EXAMPLE 40 | B | A | A | B | B |
| EXAMPLE 41 | B | A | B | B | B |
| EXAMPLE 42 | B | B | B | B | B |
| EXAMPLE 43 | B | B | B | B | B |
| EXAMPLE 44 | B | B | B | B | B |
| EXAMPLE 45 | B | B | B | B | B |
| EXAMPLE 46 | B | A | A | B | B |
| EXAMPLE 47 | B | A | B | B | B |
| EXAMPLE 48 | B | A | A | B | B |

TABLE 6

| | Fe—Ni ALLOY LAYER Ni/ (Fe + Ni ) RATIO | Fe—Sn—Ni ALLOY LAYER SURFACE COVERAGE (SEM METHOD) (%) | Fe—Sn ALLOY LAYER SURFACE COVERAGE (SEM METHOD) (%) | Sn PLATED LAYER: COATING WEIGHT OF Sn PLATED LAYER BEFORE HEAT-MELTING TREATMENT ($g/m^2$) | Sn PLATED LAYER: COATING WEIGHT OF Sn PLATED LAYER AFTER HEAT-MELTING TREATMENT ($g/m^2$) |
|---|---|---|---|---|---|
| COMPARATIVE EXAMPLE 1 | 0.13 | 13 | NO LAYER | 1.0 | 0.5 |
| COMPARATIVE EXAMPLE 2 | 0.13 | 13 | NO LAYER | 1.0 | 0.5 |
| COMPARATIVE EXAMPLE 3 | 0.13 | 13 | NO LAYER | 1.0 | 0.5 |
| COMPARATIVE EXAMPLE 4 | 0.13 | 13 | NO LAYER | 1.0 | 0.5 |
| COMPARATIVE EXAMPLE 5 | 0.13 | 13 | NO LAYER | 1.0 | 0.5 |
| COMPARATIVE EXAMPLE 6 | 0.13 | 13 | NO LAYER | 1.0 | 0.5 |
| COMPARATIVE EXAMPLE 7 | 0.13 | 8 | NO LAYER | 2.8 | 0.5 |
| COMPARATIVE EXAMPLE 8 | 0.13 | 13 | NO LAYER | 1.0 | 0.5 |
| COMPARATIVE EXAMPLE 9 | 0.13 | 13 | NO LAYER | 1.0 | 0.5 |
| COMPARATIVE EXAMPLE 10 | NO LAYER | NO LAYER | 4 | 2.8 | 1.8 |
| COMPARATIVE EXAMPLE 11 | NO LAYER | NO LAYER | 4 | 2.8 | 1.8 |
| COMPARATIVE EXAMPLE 12 | NO LAYER | NO LAYER | 4 | 2.8 | 1.8 |
| COMPARATIVE EXAMPLE 13 | NO LAYER | NO LAYER | 1 | 3.0 | 1.5 |
| COMPARATIVE EXAMPLE 14 | NO LAYER | NO LAYER | 1 | 3.0 | 1.5 |
| COMPARATIVE EXAMPLE 15 | NO LAYER | NO LAYER | 1 | 3.0 | 1.5 |
| COMPARATIVE EXAMPLE 16 | NO LAYER | NO LAYER | 1 | 3.0 | 1.5 |

| | FILM: P COATING WEIGHT ($mg/m^2$) | FILM: Si COATING WEIGHT RATIO TO P WEIGHT WEIGHT | FILM: Si COATING COATING ($mg/m^2$) | EVALUATION OF PROPERTIES: WORK-ABILITY | PAINT-ADHESION CHARAC-TERISTICS PRIMARY | PAINT-ADHESION CHARAC-TERISTICS SECONDARY | ANTI RUST PRO-PER-TIES | CORROSION RESISTANCE AFTER COATING |
|---|---|---|---|---|---|---|---|---|
| COMPARATIVE EXAMPLE 1 | 0.1 | 100.0 | 10.0 | D | B | C | C | C |
| COMPARATIVE EXAMPLE 2 | 120 | 0.083 | 10.0 | D | C | D | C | C |
| COMPARATIVE EXAMPLE 3 | 7.0 | 0.0071 | 0.05 | B | C | D | D | D |
| COMPARATIVE EXAMPLE 4 | 7.0 | 42.9 | 300.0 | B | B | C | D | C |
| COMPARATIVE EXAMPLE 5 | CHEMICAL CONVERSION TREATMENT COULD NOT BE PERFORMED SINCE CHEMICAL REAGENT WAS NOT HOMOGENEOUSLY DISSOLVED. | | | | | | | |
| COMPARATIVE EXAMPLE 6 | CHEMICAL CONVERSION TREATMENT COULD NOT BE PERFORMED SINCE CHEMICAL REAGENT WAS NOT HOMOGENEOUSLY DISSOLVED. | | | | | | | |
| COMPARATIVE EXAMPLE 7 | Cr CONCENTRATION: 5 $mg/m^2$ | | | D | B | B | B | B |
| COMPARATIVE EXAMPLE 8 | Cr CONCENTRATION: 8 $mg/m^2$ | | | D | B | B | B | B |
| COMPARATIVE EXAMPLE 9 | 0 | 0.0 | 0.0 | D | D | D | D | C |
| COMPARATIVE EXAMPLE 10 | 0.1 | 100.0 | 10.0 | D | B | D | B | C |
| COMPARATIVE EXAMPLE 11 | 140.0 | 0.071 | 10.0 | D | C | D | B | C |

TABLE 6-continued

| | | | | | | | | |
|---|---|---|---|---|---|---|---|---|
| COMPARATIVE EXAMPLE 12 | 166.7 | 0.030 | 5.0 | D | C | D | C | D |
| COMPARATIVE EXAMPLE 13 | 0.1 | 100.0 | 10 | D | C | D | C | C |
| COMPARATIVE EXAMPLE 14 | 110 | 0.09 | 10 | D | C | C | C | C |
| COMPARATIVE EXAMPLE 15 | 10 | 0.004 | 0.04 | D | C | C | C | D |
| COMPARATIVE EXAMPLE 16 | 10 | 30.0 | 300 | D | C | D | C | D |

Industrial Applicability

According to the present invention, even though chromium, which is unfavorable in environmental conservation, is not contained, a surface-treated tin-plated steel sheet having superior paint-adhesion characteristics, corrosion resistance after coating, antirust properties, and workability can be provided. In addition, compared to conventional tin-plated steel sheets, this surface-treated tin-plated steel sheet having high safety maintains its superior workability even when the coating weight of plated tin is decreased, and hence, production can be performed at a lower cost. As a result, this surface-treated tin-plated steel sheet can be widely used for cans such as DI cans, food-cans, beverage-cans, and the like.

What is claimed is:

1. A surface-treated tin-plated steel sheet comprising:

(1) an alloy layer on a surface of a steel sheet;

(2) a tin-plated layer which is provided on the alloy layer so that the alloy layer is exposed at an areal rate of 3.0% or more; and (3) a film comprising P and Si as coating weight of 0.5 to 100 mg/m$^2$ and 0.1 to 250 mg/m$^2$, respectively, provided on the exposed portions of the alloy layer and the tin-plated layer.

2. A surface-treated tin-plated steel sheet according to claim 1, wherein the film further comprises Sn.

3. A surface-treated tin-plated steel sheet according to claim 1, wherein the Si in the film is derived from a silane coupling agent having an epoxy group.

4. A surface-treated tin-plated steel sheet according to claim 1, wherein the alloy layer is at least one selected from the group consisting of a Fe—Sn alloy layer, a Fe—Ni alloy layer, and a Fe—Sn—Ni alloy layer.

5. A surface-treated tin-plated steel sheet according to claim 4, wherein the alloy layer is a composite alloy layer comprising a Fe—Ni alloy layer having a ratio Ni/(Fe+Ni) of 0.02 to 0.50 on a mass basis and a Fe—Sn—Ni alloy layer provided thereon.

6. A surface-treated tin-plated steel sheet according to claim 1, wherein the coating weight of the tin plating is in the range of 0.05 to 2.0 g/m$^2$.

7. A chemical conversion solution comprising phosphate ions, tin ions, and a silane coupling agent, wherein the pH is 1.5 to 5.5.

8. A chemical conversion solution according to claim 7, wherein the silane coupling agent comprises an epoxy group.

* * * * *